US005865664A

United States Patent [19]

Martey

[11] Patent Number: 5,865,664

[45] Date of Patent: Feb. 2, 1999

[54] JUMPING MAT POPPING TOY

[76] Inventor: Leslie Anne Martey, 400 E. 57th St., New York, N.Y. 10022

[21] Appl. No.: 394,499

[22] Filed: Feb. 27, 1995

[51] Int. Cl.[6] ..... A63H 37/00

[52] U.S. Cl. ..... 446/397; 446/491

[58] Field of Search ..... 446/397, 491; 428/158, 178

[56] References Cited

U.S. PATENT DOCUMENTS

| | | | |
|---|---|---|---|
| 3,392,081 | 7/1968 | Chavannes | 161/127 |
| 4,147,828 | 4/1979 | Heckel et al. | 482/23 |
| 4,378,391 | 3/1983 | Allen | 40/427 |
| 4,457,964 | 7/1984 | Blum | 428/43 |
| 4,472,472 | 9/1984 | Schultz | 428/178 |
| 4,911,671 | 3/1990 | Rogers | 446/397 |
| 4,950,354 | 8/1990 | Schirmer | 156/145 |
| 5,084,324 | 1/1992 | Schirmer | 428/139 |

FOREIGN PATENT DOCUMENTS

| | | | |
|---|---|---|---|
| 205758 | 12/1986 | European Pat. Off. | 428/176 |
| 2065548 | 7/1981 | United Kingdom | 428/178 |
| 2087320 | 5/1982 | United Kingdom | 238/14 |
| 2225536 | 6/1990 | United Kingdom | 446/491 |

*Primary Examiner*—Robert A. Hafer
*Assistant Examiner*—Jeffrey D. Carlson
*Attorney, Agent, or Firm*—Alvin S. Blum

[57] ABSTRACT

A mat toy is provided that has many soft microbubbles extending upward from its upper surface. Gas is sealed within each bubble. When jumped upon by a child, a bubble becomes compressed and bursts with a popping sound enjoyed by children. The soft upper layer is adherent to a stiff bottom layer. This provides sufficient rigidity that the mat lies flat when jumped upon and cannot wrap around and suffocate a child. The bottom surface is further provided with a high friction, slip or skid-resistant surface so that the mat will not slide out from under the jumping child to avoid injury. The upper layers may be light transmissive and indicia such as a colored cartoon animal may be provided at a lower layer that is visible to the child for enhanced appeal. An intermediate cushioning layer such as a closed cell foam may alternatively be provided.

15 Claims, 1 Drawing Sheet

JUMPING MAT POPPING TOY

BACKGROUND OF THE INVENTION

This invention relates to children's toys and more particularly to a mat for children to jump on that makes popping sounds.

Micro-bubble plastic laminate cushioning sheets as exemplified by U.S. Pat. No. 3,392,081 issued Jul. 9, 1968 to Chavannes and 5,084,324 issued Jan. 28, 1992 to Schirmer are well known for packing fragile items for shipment. They are generally made of polyolefin plastics soft enough so that the bubbles can be broken with a popping sound when squeezed. People enjoy breaking these bubbles to hear the popping sound. Children even enjoy jumping on the material to pop the bubbles. However, the prior art material presents several dangers to children as a plaything. The flat plastic material of the underside is slick and smooth, having a natural lubricity. It can easily slip or skid out from under a jumping child who has become accustomed to the soft landing provided by the bubbles, thereby leading to injury. The soft nature of the product that permits it to wrap around irregular objects for cushioning can result in a young child being wrapped up in the sheet and suffocated. Consequently the micro-bubble cushioning material of the prior art should not be used as a plaything for children.

SUMMARY OF THE INVENTION

It is accordingly an object of the invention to provide a plaything or toy for children that offers the fun of popping the micro bubbles while avoiding the combined hazards of slipping on a support surface or wrapping and suffocating a small child. The toy of the invention comprises a laminated mat having an upper surface with the soft plastic breakable bubbles of the type used for cushioning and a skid resistant under surface. The laminate is further provided with sufficient stiffness that it resists wrapping around a child enough to cause suffocation.

These and other objects, advantages and features of the invention will become more apparent when the detailed description is studied in conjunction with the drawings.

DETAILED DESCRIPTION OF PREFERRED EMBODIMENTS

Figure 2:
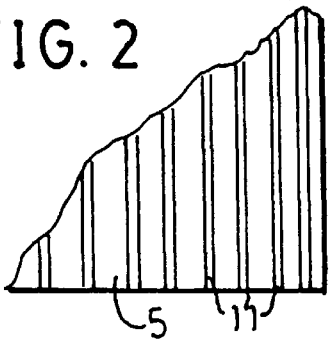
FIG. 2 is a bottom plan view of a portion of the mat of FIG. 1.
Figure 3:
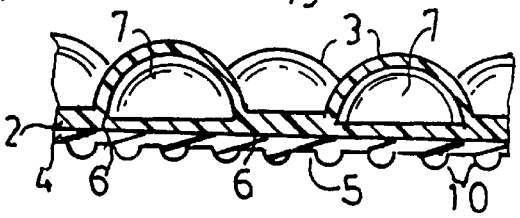
FIG. 3 is a sectional view taken through line 3—3 of FIG. 1.
Figure 1:
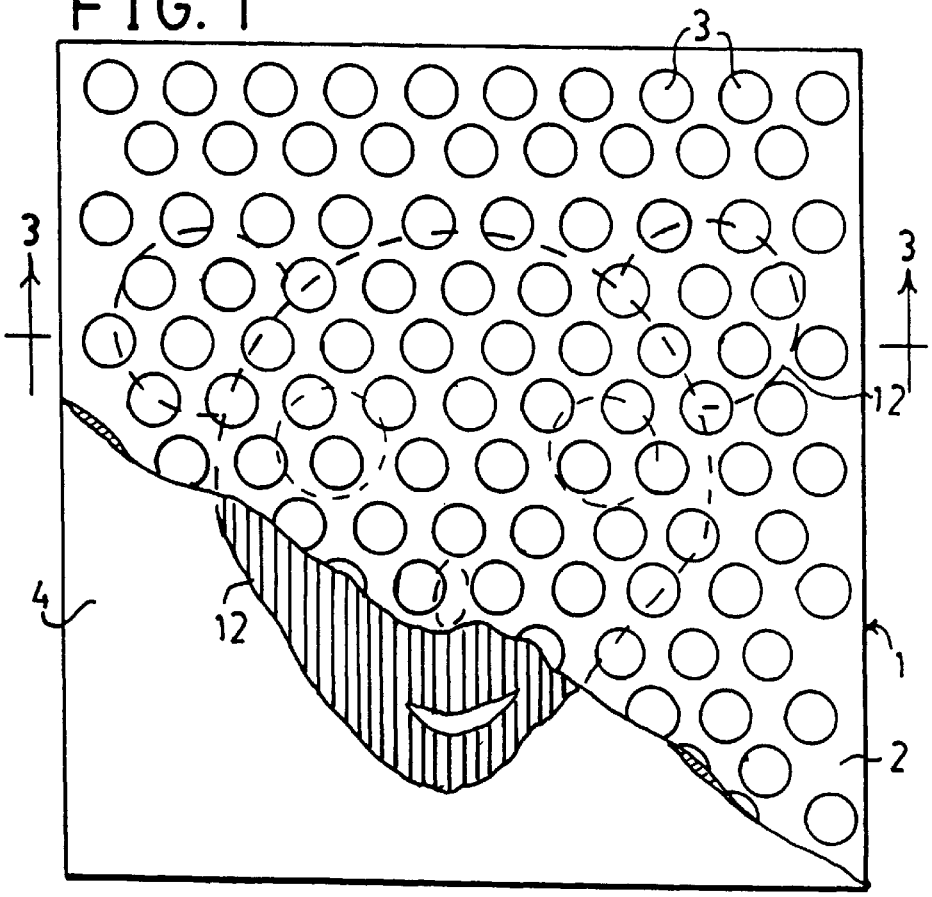
FIG. 1 is a top plan view of the mat of the invention.

Referring now first to FIGS. 1–3, the laminated popping mat 1 has a soft top layer 2 provided with an array of soft microbubbles 3 extending upward from the top layer 2. Each bubble is sealed to the top layer 2 by seals 6 so that gas is trapped within the bubble. The bubbles with their entrapped air provide a soft cushioned upper surface. When excessive pressure is applied, such as by jumping on the surface, the trapped air 7 is pressurized and the bubbles burst individually with a loud popping sound. The top layer 2 and bubbles 3 are made of a soft, transparent or translucent plastic such as polyolefin or copolymers thereof. This is so soft and yielding that it can readily fold over and smother a child. It can also fold over so that a jumping child lands on a hard floor instead of the soft mat. The olefinic plastics are generally slippery so that the underside might slip when a child jumps on the mat causing injury. The mat 1 of the invention is provided with an adhered bottom layer 4 that is sufficiently stiff or rigid that it prevents the mat from folding over and smothering a child. It keeps it flat on the floor so that the entire area is always presented as a target for the jumping child. The bottom layer 4 is provided with a slip-resistant bottom surface 5. This may be provided with a plurality of projections 10 extending from the surface 5 to further increase friction and prevent sliding or skidding on a supporting surface.

The projections may take the form of embossed parallel ridges 11 as best seen in FIG. 2.

Figure 4:
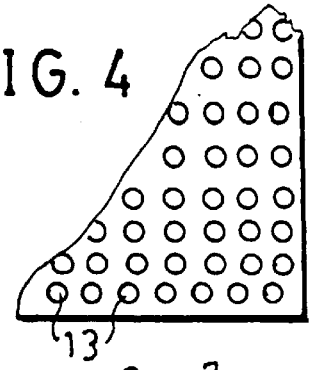
FIG. 4 is a bottom plan view of an alternative embodiment of the invention.

FIG. 4 shows another bottom surface with a plurality of embossed hemispheres 13.

Figure 5:
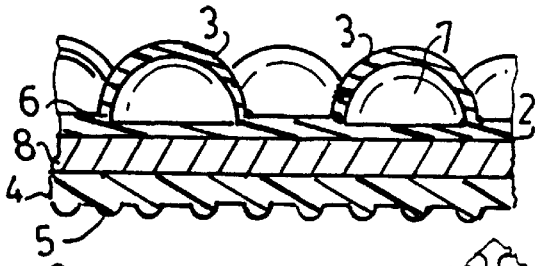
FIG. 5 is a sectional view as in FIG. 3 of an alternative embodiment of the invention.

FIG. 5 shows in section another embodiment of the invention, in which an intermediate cushioning and/or stiffening lamina or layer to provide shock-absorbing properties to the mat after the bubbles have burst 8 is interposed between top and bottom layer. This may be a closed cell foam of the type well known in the art.

The mat of the invention may be made more attractive to children by providing an image or indicia 12 in bright colors as shown in phantom in FIG. 1. This indicia may be in a lower layer that is visible through the transparent or translucent top layer and bubbles. In the portion of FIG. 1 in which the top layer 2 is broken away, the indicia 12 is shown as red in color.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A laminated popping mat comprising:

a top layer having a plurality of soft, resilient sealed micro-bubbles, said bubbles being capable of bursting with a popping sound when jumped upon;

a bottom layer providing a slip-resistant surface to resist skidding during jumping when resting on a supporting surface; and the mat provided with sufficient stiffness to prevent wrapping around a child, to thereby prevent suffocation.

2. The mat according to claim 1 further comprising an intermediate resilient cushioning layer interposed between said top layer and said bottom layer to provide shock-absorbing properties to said mat after the bubbles have burst.

3. The mat according to claim 2, in which said intermediate layer is a closed cell foam.

4. The mat according to claim 1, in which said slip-resistant surface includes embossed projections.

5. The mat according to claim 4, in which said embossed projections are parallel ridges.

6. The mat according to claim 2, in which said slip-resistant surface includes embossed projections.

7. The mat according to claim 6, in which said embossed projections are parallel ridges.

8. A micro-bubble laminate toy comprising:

a top layer having a plurality of soft elastic bubbles projecting upward therefrom to which the bubbles are sealed to trap gas within each bubble, said bubbles being capable of bursting with a popping sound when jumped upon; and a bottom layer adhered to said top layer, said bottom layer having a high friction bottom surface to prevent said toy from sliding over a supporting surface when the toy is jumped upon, said bottom layer imparting sufficient stiffness to said toy to prevent the toy from wrapping around a child, to thereby prevent suffocation.

9. The toy according to claim 8, in which the bottom layer is provided with a plurality of surface projections to enhance frictional resistance.

10. The toy according to claim 9, in which said surface projections include parallel ridges.

11. The toy according to claim 8 further comprising a closed cell foam intermediate cushioning layer interposed between the top and bottom layers.

12. The toy according to claim 11, in which said high friction bottom surface is provided with a plurality of surface projections to enhance frictional resistance.

13. The toy according to claim 12, in which said surface projections are parallel ridges.

14. The toy according to claim 8, in which said top layer is light transmissive and indicia is provided on said bottom layer that is visible from above said toy.

15. The mat according to claim 1, in which said top layer is light transmissive and indicia is provided on said bottom layer that is visible from above said mat.

* * * * *